US005154414A

United States Patent [19]

Auer et al.

[11] Patent Number: 5,154,414

[45] Date of Patent: Oct. 13, 1992

[54] DEFLECTABLE BASKETBALL GOAL

[75] Inventors: Robert T. Auer, East Stroudsburg; Calvin Cook, Erie, both of Pa.

[73] Assignee: SLM, Inc., New York, N.Y.

[21] Appl. No.: 112,765

[22] Filed: Jan. 6, 1992

[51] Int. Cl.[5] ..... A63B 63/08

[52] U.S. Cl. ..... 273/1.5 R

[58] Field of Search ..... 273/1.5 R,A

[56] References Cited

U.S. PATENT DOCUMENTS

| | | | |
|---|---|---|---|
| 1,583,011 | 5/1926 | Roe | 273/1.5 R |
| 3,788,642 | 1/1974 | Matras et al. | 273/1.5 R |
| 4,285,518 | 8/1981 | Pearo | 273/1.5 R |
| 4,365,802 | 12/1982 | Ehrat | 273/1.5 R |
| 4,534,556 | 8/1985 | Estlund | 273/1.5 R |
| 4,676,503 | 6/1987 | Mahoney et al. | 273/1.5 R |
| 4,793,611 | 12/1988 | Thornell | 273/1.5 R |
| 5,037,092 | 8/1991 | Blackburn | 273/1.5 R |

*Primary Examiner*—Paul E. Shapiro
*Attorney, Agent, or Firm*—Michael Ebert

[57] ABSTRACT

A basketball goal provided with a hoop from which is suspended a net, and a mounting assembly adapted normally to support the hoop on a backboard at a horizontal position. But when the hoop is subjected to a downward force by a player, the hoop is then momentarily deflected to absorb this force and thereby prevent damage to the goal and injury to the player. The assembly includes a mounting plate attached to the backboard and a hinge component secured to the front of the mounting plate, the component having a channel therein parallel to the plate and aligned at its midsection with a slot formed in the plate. Also included is a clevis formed by a rod shaped to define a pair of parallel legs that are joined to the hoop and are integral with inwardly-directed pin elements received in the channel, thereby pivoting the hoop on the hinge component, the pin elements merging with arms in abutting relation forming a cantilever crank that passes through the slot and projects from the rear of the mounting plate. Connected between the end of the crank and a point on the plate below the slot is a spring that acts to maintain the hoop is deflected by a downward force, the spring is then stretched and acts to return the hoop to its normal position.

7 Claims, 1 Drawing Sheet

Fig. 1
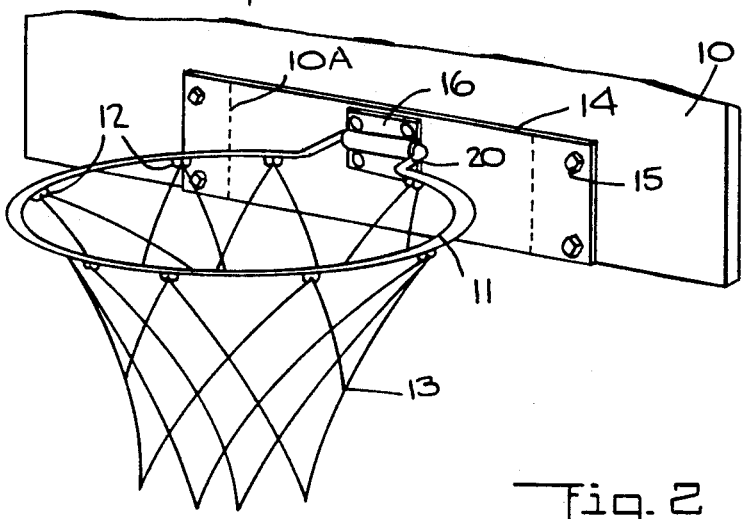
Fig. 2
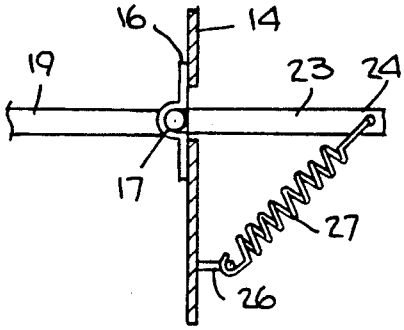
Fig. 4
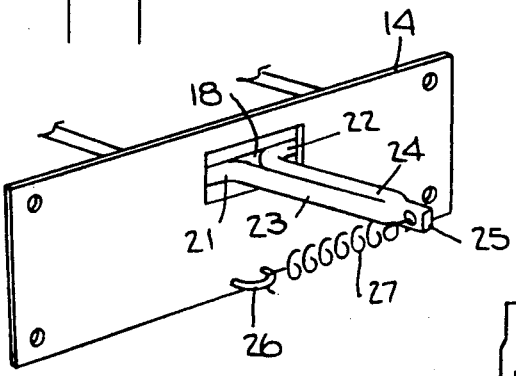
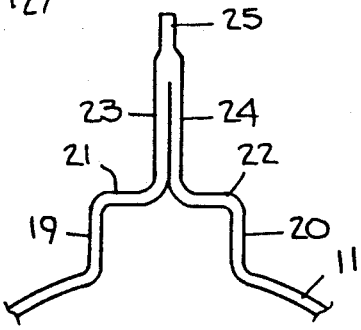
Fig. 3
Fig. 5
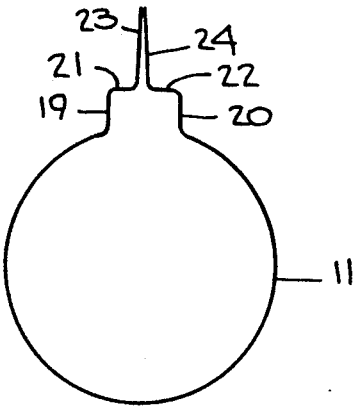
Fig. 6
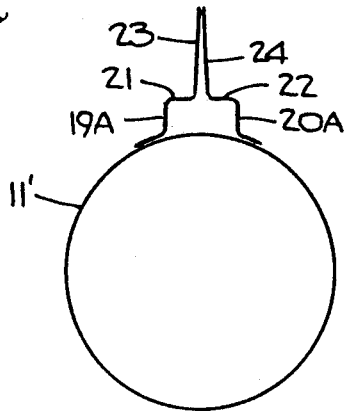

DEFLECTABLE BASKETBALL GOAL

BACKGROUND OF INVENTION

1. Field of Invention:

This invention relates generally to a basketball goal, and more particularly to a goal whose hoop from which a net is suspended is so mounted on a backboard, that when the hoop is subjected to a downward force by a player, the hoop is then momentarily deflected to absorb the force and thereby avoid damage to the goal and injury to the player.

2. Status of Prior Art:

The game of basketball, which is played throughout the world both indoors and out by professionals and amateurs, makes use of a basketball and two goals, one for each end of a playing court. The goal includes a metal ring or hoop from which a mesh net is suspended, the net acting to momentarily check the basketball as it passes therethrough. The hoop is mounted on an elevated backboard, often formed of temper-plate glass.

The normal practice is to rigidly mount the hoop so that it is horizontal and extends forwardly from the vertical backboard. This mounting must be sufficiently rigid so that the hoop is capable of withstanding the forces applied thereto by a player during a game. These forces are created by the ball bouncing on the hoop or by players coming in contact with the hoop.

In recent years, as players have become taller, the goal has been subjected to increasing abuse as a result of contact with players, giving rise not only to damage to the hoop but also, in some instances, to injury to the player.

A common tactic in playing basketball is the so-called "slam dunk shot," in which the player jumps upwardly with the ball held in his outstretched arms and hands, the ball then being driven downwardly through the hoop. In carrying out this dunk shot, the player makes forceful contact with the hoop by slapping, hitting or pulling the hoop with his hands, wrists or arms.

When the hoop is rigidly mounted, the forces exerted on the hoop by various executions of a slam dunk shot may cause deformation of the hoop. A more serious problem is that the glass backboard on which the hoop is mounted will sometimes shatter under the forces arising from this shot.

One prior art solution to the problem is to provide, as disclosed in the Mahoney et al. Pat. No. 4,676,503, a breakaway mounting assembly in which the hoop, when subjected by the player to an excessive force, then simply collapses or breaks away from its normal position on the backboard. The drawback to this arrangement is that it interrupts the game which cannot be resumed until the goal is reassembled.

The approach to this problem that is of greater prior art interest with respect to the present invention is that disclosed in the Tyner Pat. No., 4,194,734, in which the hoop of the goal is joined to a spring-biased bracket, so that when a player executes a slam dunk shot and comes in contact with the hoop, the hoop then swings down from its normal horizontal position to absorb the resultant shock.

The Tyner arrangement is relatively elaborate and costly. It requires that the hoop be joined to a bracket hinged to the front side of a backboard, a pair of bolts passing through bores in the backboard being coupled at one end to the front brackets and at the other end to a plate behind the backboard which engages the piston rod of a shock absorber mounted on a rear bracket. Each bolt is surrounded by a helical spring which is compressed when the hoop is deflected and the front bracket then swings down, the compressed spring thereafter recovering its uncompressed state, and in doing so, acting to compress the shock absorber and to return the hoop to its normal horizontal position.

The resiliently-biased mounting for a basketball disclosed in the De Faveri Pat. No., 4,575,079, is also mechanically complex, for it involves three brackets nested relative to each other, a first spring urging the second bracket toward its normally nested position relative to the first bracket, and a second spring independent of the first, urging the third bracket toward its normal position relative to the second bracket.

Also of prior art interest is the basketball rim assembly disclosed in the Simonseth Pat. No., 4,433,839, which discloses a release mechanism including springs which permit deflection of the rim in response to a downward force, as well as the Ehrat Pat. No., 4,365,802, which discloses a swingable mount for a basketball goal. Engle et al. Pat. No., 4,438,923, shows a basketball goal having a mounting frame that includes a curved leaf spring to provide a resilient coupling.

In all of the above prior art patents, the mounting for the hoop which permits deflection of the hoop to absorb a downward force applied thereto is a relatively complicated mechanism that is expensive to manufacture and requires adjustment or maintenance for proper operation.

SUMMARY OF INVENTION

In view of the foregoing, the main object of this invention is to provide a basketball goal having a simple mounting assembly adapted normally to support a hoop on a backboard at a horizontal position, but which when the hoop is subjected to a downward force by a player is then momentarily deflected to absorb this force and thereby prevent damage to the goal and injury to the player.

The invention is of particular advantage in those situations where the goal takes the form of a portable goal rather than one in which the backboard is permanently mounted on a pole anchored in the ground. Typically, one use for a portable basketball goal is for a game set up at a swimming pool where the goal is temporarily placed at the edge of a the pool so that players in swim suits can toss a ball into the basket. In an installation of this type, should the hoop of the basket be rigidly held onto the backboard, then a dunk shot in which the player makes vigorous contact with the hoop may upset the portable goal and cause it to fall against the tiled edge of the swimming pool or into the pool itself, with possible damage to the goal or injury to the player. With a mounting assembly in accordance with the invention, the force applied to the hoop by a player is absorbed, thereby reducing the likelihood that the portable goal will be upset.

A significant feature of the invention is that the mounting assembly included in the goal is mainly created by a rod shaped to define a bracket that is joined to the hoop, the bracket being hinged on a mounting plate attached to the backboard and having a cantilever crank integral therewith that is spring-biased to permit swinging movement of the hoop.

Also an object of the invention is to provide a simple, low-cost mounting assembly for a basketball goal that makes use of a single spring, the assembly being reliable in operation and requiring no maintenance or adjustment.

Briefly stated, these objects are attained in a basketball goal provided with a hoop from which is suspended a net, and a mounting assembly adapted normally to support the hoop on a backboard at a horizontal position. But when the hoop is subjected to a downward force by a player, the hoop is then momentarily deflected to absorb this force and thereby prevent damage to the goal and injury to the player.

The assembly includes a mounting plate attached to the backboard and a hinge component secured to the front of the mounting plate, the component having a channel therein parallel to the plate and aligned at its midsection with a slot formed in the plate. Also included is a clevis formed by a rod shaped to define a pair of parallel legs that are joined to the hoop and are integral with inwardly-directed pin elements received in the channel, thereby pivoting the hoop on the hinge component, the pin elements merging with arms in abutting relation forming a cantilever crank that passes through the slot and projects from the rear of the mounting plate. Connected between the end of the crank and a point on the plate below the slot is a spring that acts to maintain the hoop at its normal horizontal position, whereby when the hoop is deflected by a downward force, the spring is then stretched and acts to return the hoop to its normal position.

BRIEF DESCRIPTION OF DRAWINGS

For a better understanding of the invention as well as other objects and further features thereof, reference is made to the following detailed description to be read in conjunction with the accompanying drawings, wherein:

FIG. 1 is a perspective view of a basketball goal that includes a preferred embodiment of a mounting assembly in accordance with the invention for supporting a hoop on a backboard:

FIG. 2 is a transverse section taken through the mounting plate of the assembly;

FIG. 3 illustrates the relationship between the hinge component of the assembly and the clevis pivoted thereon;

FIG. 4 is a perspective view showing the rear of the mounting plate of the assembly;

FIG. 5 is a separate plan view of the clevis of the assembly; and

FIG. 6 is a separate plan view of another embodiment of the clevis.

DESCRIPTION OF INVENTION

Referring now to FIGS. 1 to 5, there is shown a basketball goal that includes a mounting assembly in accordance with the invention for supporting a basket on a backboard 10, which in practice may be made of tempered glass or other high-strength material. The basket is constituted by a metal hoop 11 having welded to its underside at equi-spaced positions a series of coil-type couplers 12. An open-mesh net 13 is suspended from couplers 12 to receive a ball thrown into a hoop. A mounting assembly, including a rectangular metal mounting plate 14, functions normally to support hoop 11 on the vertical backboard at a horizontal position. But when the hoop is subjected to a downward force by a player, the hoop is then momentarily deflected to absorb this force and thereby prevent damage to the goal and injury to the player.

Mounting plate 14 is secured to the lower edge of backboard 10 at its center, the plate covering a rectangular indentation 10A in the backboard and being attached thereto to a set of bolts 15 that pass through bores at the corners of the plate.

Riveted, bolted, or otherwise attached to the front of mounting plate 14 adjacent its upper edge is a metal hinge component 16 in the form of a small rectangular plate that has a corrugation therein to define a longitudinal channel 17. The midsection of channel 17 is aligned with a slot 18 in the mounting plate.

Hoop 11, which is an incomplete ring, is integral with a clevis that is pivotally supported on hinge component 16. The hoop and the clevis at created from a single length of a metal rod that is bent to define both the hoop and the clevis. The clevis includes a pair of parallel legs 19 and 20 that merge with the ends of hoop 11 and therefore function as a supporting bracket for the hoop. Bracket legs 19 and 20 are integral with inwardly-directed pin elements 21 and 22 received in channel 17 of hinge component 16, thereby pivoting the hoop bracket on this component.

Pin elements 21 and 22 of the shaped rod are integral with arms 23 and 24 at right angles thereto, the arms being in abutting relation to form a cantilever crank. The crank passes through slot 18 in mounting plate 14 and projects rearwardly therefrom to terminate in a lug 25 having a hole therein.

Connected between lug 25 of the crank and loop 26 welded to the rear of mounted plate 14 above slot 18 therein is an expandable helical spring 27. The ends of the spring are shaped into hooks, one going into the hole in lug 25, the other being hooked onto loop 26. The spring acts to maintain hoop 11 normally at a horizontal position.

When, however, a downward force is applied to the hoop by a player, the pivotally mounted hoop is momentarily deflected thereby, as a result of which spring 27 is stretched. And when the hoop is then free of the player's hand, wrist or arm, the stretched spring then acts to return the hoop to its normal horizontal position.

The advantage of this arrangement, which can best be appreciated by the view of the hoop and clevis shown in FIG. 5, is that a single rod serves to define not only hoop 11, but also legs 19 and 20 which act as a bracket thereto, the inwardly-directed pin elements 21 and 22 which serve to pivot the bracket on the hinge component and the abutting arms 23 and 24 which form the cantilever crank that is spring-biased.

Where it is desired to provide a more professional basketball goal, then, as shown in FIG. 6, rather than an incomplete ring as shown in FIG. 5, the hoop 11' is now a complete metal ring. In this embodiment, the clevis, which is formed by separate bent metal rod has the ends of its legs 19A and 20A welded to the complete ring, the arrangement otherwise being essentially the same as that shown in FIGS. 1 to 4.

While there has been shown and described preferred embodiments of a deflectable basketball goal in accordance with the invention, it will be appreciated that many changes and modifications may be made therein without, however, departing from the essential spirit thereof.

I claim:

1. A basketball goal provided with a hoop from which is suspended a net, and a mounting assembly adapted normally to support the hoop on a backboard at a horizontal position, but when the hoop is subjected by a player to a downward force, the hoop is then momentarily deflected to absorb this force, said assembly comprising:

(a) a mounting plate secured to said backboard and having a slot therein;

(b) a hinge component secured to the face of the mounting plate, said component having a longitudinal channel parallel to the mounting plate and aligned at its midsection with said slot;

(c) a clevis formed by a length of rod shaped to define a pair of parallel legs joined to said hoop and integral with inwardly-directed pin elements received in said channel, pin elements merging with arms at right angles thereto which are in abutting relation to form a cantilever crank that passes through the slot and projects from the rear of the mount plate; and (d) an expandable helical spring connected between the end of the crank and a point on the rear of the mounting plate below the slot to maintain the hoop at its normal position, the spring being stretched when the hoop is deflected and acting to then return the hoop to its normal position.

2. A goal as set forth in claim 1, wherein said hoop is provided at its underside with a series of coil-shaped couplers to support said net.

3. A goal as set forth in claim 1, wherein said hinge component is formed by a rectangular plate having a corrugation therein to define said channel.

4. A goal as set forth in claim 1, wherein said crank has a lug at its end and is provided with a hole, and said point at the rear of the mounting plate has a loop attached thereto, said spring having end hooks, one going into said hole and the other hooking onto said loop.

5. A goal as set forth in claim 1, wherein said rod is a single length of metal which is shaped to form an incomplete ring that defines both hoop and said clevis.

6. A goal as set forth in claim 1, wherein said hoop is a complete metal ring and the legs of the clevis are welded to said ring.

7. A goal as set forth in claim 1, wherein said backboard is formed of tempered glass and has an indentation therein to expose the slot of the mounting plate.

* * * * *

UNITED STATES PATENT AND TRADEMARK OFFICE

CERTIFICATE OF CORRECTION

PATENT NO. : 5,154,414

DATED : October 13, 1992

INVENTOR(S) : Robert T. Auer, et al

It is certified that error appears in the above-identified patent and that said Letters Patent is hereby corrected as shown below:

On the title page, Item [21]: "Appl. No. 112,765" should read --Appl. No. 819,370--.

Signed and Sealed this

Twenty-first Day of September, 1993

Bruce Lehman

*Attest:*

BRUCE LEHMAN

*Attesting Officer*

*Commissioner of Patents and Trademarks*